United States Patent [19]

Wislocker et al.

[11] Patent Number: 4,653,560

[45] Date of Patent: Mar. 31, 1987

[54] FIXED CURVE LINEBAR

[75] Inventors: Frank Wislocker, Sumner; Earl D. Hasenwinkle, Puyallup, both of Wash.

[73] Assignee: Weyerhaeuser Company, Tacoma, Wash.

[21] Appl. No.: 814,137

[22] Filed: Dec. 27, 1985

[51] Int. Cl.[4] ..... B27C 1/12

[52] U.S. Cl. ..... 144/242 E; 83/102.1; 83/404.1; 83/446; 144/41; 144/253 H; 144/376; 144/378

[58] Field of Search ..... 144/39, 41, 145 R, 249 R, 144/242 E, 357, 253 G, 253 H; 83/102.1, 404.1, 404.2, 441.1, 449, 367, 371, 378, 64

[56] References Cited

U.S. PATENT DOCUMENTS

| | | | |
|---|---|---|---|
| 259,661 | 6/1882 | Bowker . | |
| 1,263,443 | 4/1918 | Lien . | |
| 3,665,984 | 5/1972 | Ackerfeldt | 143/26 A |
| 3,685,556 | 8/1972 | VanSickle | 143/26 A |
| 4,144,782 | 3/1979 | Lindstrom | 83/102.1 |
| 4,219,056 | 8/1980 | Lindstrom | 143/3 |
| 4,373,563 | 2/1983 | Kenyon | 144/357 |
| 4,416,312 | 11/1983 | Ostberg | 144/39 |

FOREIGN PATENT DOCUMENTS

| | | |
|---|---|---|
| 49-7557 | 2/1974 | Japan . |
| 33098 | 12/1908 | Sweden . |
| 306415 | 12/1968 | Sweden . |
| 545 | of 1852 | United Kingdom . |

*Primary Examiner*—W. D. Bray

[57] ABSTRACT

The present invention comprises the combination of an elongated curved linebar with at least one saw. This arrangement enables "sawing-around-the-curve" so that increased recovery can be obtained from cants or logs having significant amounts of sweep. The linebar is positioned so that a tangent at the end adjacent to the saw is parallel to the plane of the saw. The linebar is preferably curved so that it approximates the average curvature of the cants or logs being fed to the saw. An auxilliary straight line bar, which is normally out of contact with an incoming cant, may alternatively be moved into position when the incoming cant is relatively straight sided.

9 Claims, 10 Drawing Figures

FIXED CURVE LINEBAR

BACKGROUND OF THE INVENTION

The present invention is a linebar for guiding logs or cants into a saw. It is especially useful for guiding cants which may have significant amounts of sweep into a gangsaw in order to increase the recovery of saleable lumber.

Within a few more years, the last of the old growth timber available for harvesting in the United States will have been cut. Most of the sawmills which formerly depended on large old growth logs have already had to convert the equipment in their mills to that which is suitable for handling much smaller logs at high throughput volumes. One common characteristic of second growth timber is that the logs usually have varying but larger amounts of sweep or curvature. The presence of sweep results in yields which are significantly lower than those which are attainable from straight logs. This is because much of the curved portion must be machined off in order to produce cants or lumber having the usual configuration of a rectangular parallelepiped.

Many small log sawmills orient the log prior the primary breakdown saw so that the greatest curvature is either up or down (horns up or horns down) rather than side to side. These opening cuts may be either made by saws or by chippers which reduce the sides of the log to wood chips suitable for pulping. The result is a cant having parallel faces on two sides. As noted earlier, cants sawn in this fashion tend to have appreciable sweep. Sweep is here defined to mean the curvature on the concave edge of the cant when the cant is placed on one of its flat faces. While occasional instances of extreme sweep occur, in most cases sweep is rarely larger than about 100 mm in a cant approximately 5 m long (about 4 in. in 16 ft.). Most typically, it will average between 25 and 50 mm in 5 meters.

Man has had to attempt to cope with geometric irregularities in logs ever since he began to utilize trees. Thus, it is not unexpected that the prior art shows previous attempts to deal with sweepy cants and to devise schemes for improving the yield from cants of this type.

As general background to the present invention, reference can be made to U.S. Pat. Nos. 259,661 to Bowker and 1,263,443 to Lien. Both of these inventors devised schemes for sawing wooden barrel hoops along a path that was precisely parallel to the outside surface of the log. This was deemed necessary in order to reduce the presence of cross grain which would reduce the strength of the hoop. Somewhat more pertinent is Great Britain Pat. No. 545 of 1852. In this sawing device, a tree was placed on a carriage which could be moved in a circular arc with respect to a saw. The purpose here appears to be to cut complex curved and/or angled ships timbers. However, it appears inherent in the invention that cuts could be made parallel to the surface of a curved log.

Japanese Pat. No. 49-7557 shows a device used for "sawing around the curve" of a cant which contains sweep. The cant is first sawn to produce one good edge parallel to the original surface. After this point, additional boards can be taken off parallel to this surface by manually steering the cant as it emerges from the saw.

Swedish Pat. No. 33,098 is a sawing device having feed rolls which can be canted so that the axes lie at an angle and intersect at a point corresponding to the arc of a curve along which a cut is to be made. U.S. Pat. No. 3,685,556 to VanSickle takes a somewhat different approach. This inventor shows a device for use with a shop band saw for cutting predetermined contoured pieces from straight stock to make; e.g., Christmas tree stands. More conventional approaches are described in U.S. Pat. Nos. 3,665,984 to Ackerfeldt, 4,416,312 to Ostberg and Swedish Pat. No. 306,415. These, in general, deal with positioners for optimizing yields from curved cants by straight line sawing. The patent Ackerfeldt is valuable for the background it gives to this type of approach.

While it has been noted that increased yields can be obtained by "sawing around the curve", until very recently nothing has been done to make this a practical approach in a modern, high-speed sawmill. The closest examples can be found in U.S. Pat. Nos. 4,144,782 and 4,219,056 to Lindstrom and U.S. Pat. No. 4,373,563 to Kenyon. The earlier of the two Lindstrom patents is of particular interest. In the device described, a log is fed into what is preferably a single band saw along a path which follows the curvature of the log. The log lies on a roll case with two pairs of opposing vertical guide rollers upstream from the saw. These guide rollers embrace the cant as it is fed into the saw. They are mounted on frames transversely displaceable to the path of the log so that the log is directed along a curve to which the saw blade is tangent. Lindstrom further notes that the bowed boards resulting from around-the-curve sawing will generally flatten out when they are kiln dried. Kenyon shows a somewhat similar system. However, the cant is oriented by lateral pressure applied only to one side of the cant by a roller located upstream from the point of sawing.

To the present inventor's knowledge, the devices taught by Lindstrom and Kenyon have had limited commercial application although their use has not become widespread. This may possibly be because they are of limited use in a high-speed sawmill which may typically run 10–20 cants per minute through a gangsaw.

The present invention is a simple solution for around the curve sawing of cants having predictable amounts of sweep.

SUMMARY OF THE INVENTION

The present invention is a linebar assembly for guiding a cant or log into a saw. It is particularly well adapted for increasing recovery from a log supply which tends to have significant sweep. The assembly includes an elongated curve linebar associated with a saw. This is positioned so that one end of the linebar is adjacent to the saw. A tangent to the point on the linebar adjacent to the central portion of the saw must be essentially parallel to the plane of the saw in the locale of cutting. If the saw is a circular saw, the linebar would be tangent at the centerline of the arbor. If the saw is a bandsaw, the point of tangency would be at the center of the band, measured in the transverse direction. The linebar is curved so that it approximates an arc of a circle having a radius falling between about 30 meters and 150 meters, preferably between 40 meters and 115 meters. Curvature of the linebar is preferably selected to approximate the average curvature or sweep of logs or cants being fed into the saw. By this arrangement the cants or logs are guided into the saw along a path approximating their own radius of curvature. This enables the logs to be sawn "around the curve" resulting in higher recovery and longer average lumber lengths than would be possible using straight line sawing.

The assembly with the fixed curve linebar is particularly well adapted for feeding cants into gangsaws. These would typically be single or double arbor circular gangs. However, the invention is equally usable with other sawing arrangements which could include bandsaws or reciprocating sash gangsaws.

Optionally, the assembly may have a side pressure means, such as a press roll, to maintain the cant or log in tight contact with the linebar in the neighborhood of the saws.

Another optional arrangement of the linebar assembly includes in combination an operator selectable straight linebar for use when a straight sided cant or log appears in the infeed mix. The straight linebar is pivotally mounted adjacent to the saws, preferably pivotally attached to the curved linebar as close to the tangent point as possible. The straight linebar has an associated control means to swing it into and out of position so that it may take priority over the curved linebar. With this arrangement the saw operator can decide which of the infeed patterns will give the highest yield from a given log or cant.

In another version of the invention, one of the assemblies just described can be further combined with a translating means to control the offset distance between the linebar in the first or "zero" saw. In this version the linebar is attached to a series of mechanical or other types of linkages which enable it to be moved toward or away from the first saw according to the desires of the machine operator.

It is an object of the present invention to provide a simple apparatus for increasing lumber recovery from cants or logs tending to have significant sweep.

It is another object to provide apparatus for sawing sweepy logs or cants parallel to their radius of curvature.

It is a further object to provide an apparatus which can obtain increased lumber recovery from a mixed population of straight and sweepy logs or cants.

It is yet another object to provide an apparatus that can rapidly and simply switch from sawing cants or logs around their radius of curvature to straight line sawing.

These and many other objects will become readily apparent to those skilled in the art upon reading the following detailed description taken in conjunction with the drawing.

DESCRIPTION OF THE PREFERRED EMBODIMENTS

Figure 1:
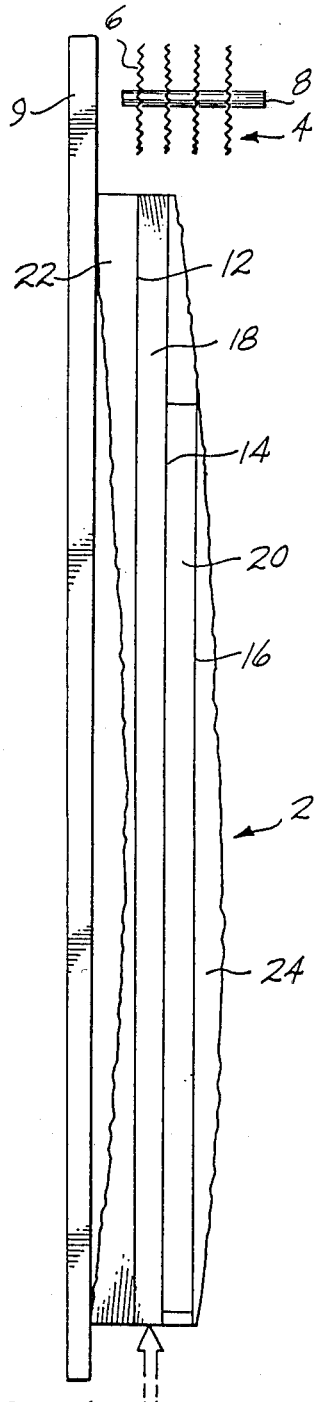
Fig. 1 PRIOR ART
FIG. 1 is top plan view that shows the projected lines of cut and expected recovery from a tapered sweepy cant cut in a circular gang saw by conventional straight line sawing.
Figure 2:
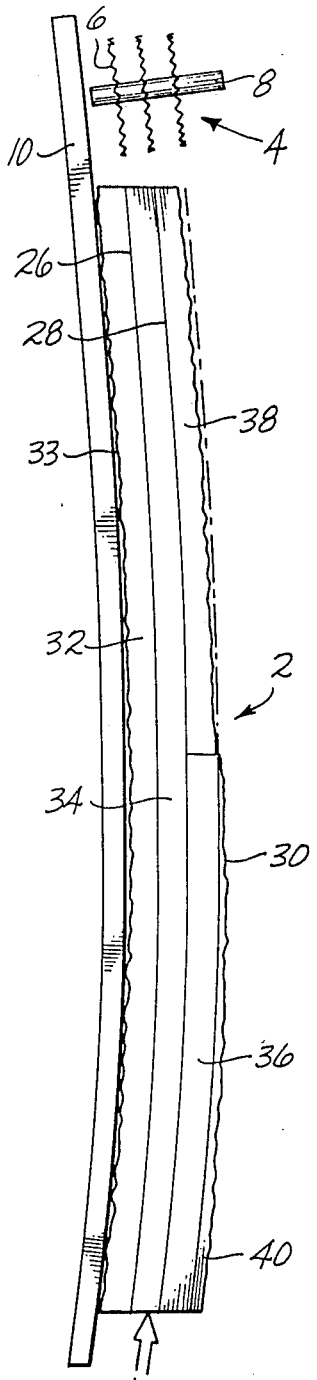
FIG. 2 shows the projected lines of cut and expected recovery from the identical sweepy cant cut "around-the-curve" by the method of the present invention.

The advantages of the present invention will be readily apparent by reference to FIGS. 1 and 2. In FIG. 1 we see a sweepy cant, generally shown at 2, about to be fed in a straight line path into a circular gangsaw in which a number of blades 4 are mounted on a common arbor 8. The cant is guided into the saw by contact with a straight linebar 9. The offset distance between linebar 9 and reference or zero saw 6 is often made adjustable so that the sawyer can maximize recovery from a given cant. Lines 12, 14, and 16 show the projected lines of cut on cant 2. In the present example it is assumed that this cant is about 150 mm (6 in) in thickness and 6.1 m (20 ft) in length with a width of 130 mm (5 in) at the smaller infeed end and 180 mm (7 in) at the wider end. The cant has a measured sweep of 51 mm in 5 m of length. In the example shown in FIG. 1, recovery from the log is one piece of lumber 18 that is 50 mm in thickness and 6.1 m in length and a second piece 20 that is 50 mm in thickness and 4.9 m in length. Edgings 22 and 24 represent waste which would nominally be sent to a chipper.

FIG. 2 shows the same cant as it would be fed to the gangsaw using a curved linebar of the present invention. This linebar 10 has a curvature of 50 mm in 5 m corresponding to the sweep present in the cant. This amount of sweep can be expressed in other terms as corresponding to a curve having a radius of 62.5 m. The cant will be sawn along projected lines 26, 28 and 30. In the example of FIG. 2 it will yield two pieces of lumber 26, 28, each 6.1 m in length and one piece 36 3 m in length. Trim pieces 38 and 40 represent waste. It is assumed in the present example that the wane edge 33 of board 32 is not so severe as to unacceptable. By sawing around the curve in the fashion just described the recovery in the case of this particular cant is increased 39% when compared with straight line sawing.

In actual practice, the curvature of the linebar is generally selected to conform to approximately the average curvature of the population of cants which will be fed to the saw. This can be readily determined by measuring sweep of a significant sample of cants drawn from the total population. In one southern pine mill a linebar having a radius of 67 m was used in conjunction with a circular single arbor gangsaw. This radius corresponds to a sweep height of about 44 mm in 4.9 m (1¾ in in 16 ft). Lumber recovery through this gangsaw averaged approximately 5–10% higher over long-time operation compared with a similar population of cants processed with a straight linebar. A recovery increase of this magnitude is very significant in terms of sawmill economics.

Figure 3:
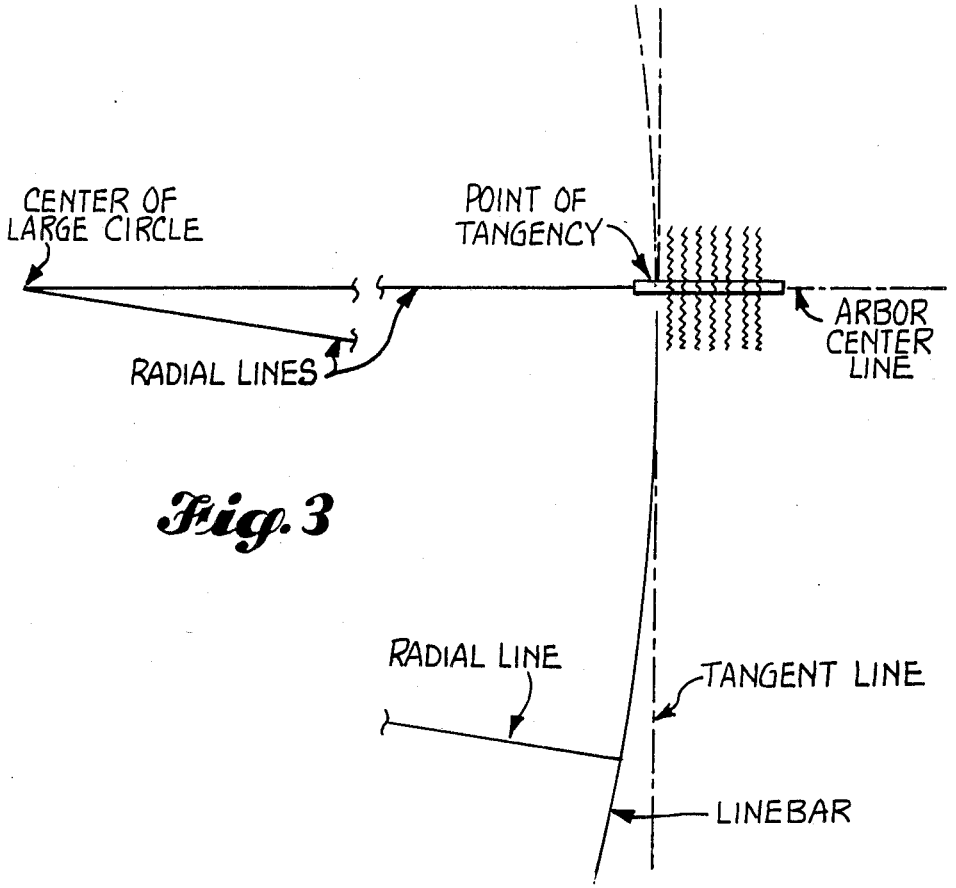
FIG. 3 shows the geometric relationship between the fixed curve linebar and saws of the present invention.

FIG. 3 shows the orientation of the linebar with reference to a circular gangsaw. A tangent line to the linebar at a projection of the centerline of the arbor must lie parallel to a plane holding the zero saw. All of the other saws in a gangsaw will normally lie in planes which are parallel to each other and to the tangent line.

Figure 4:
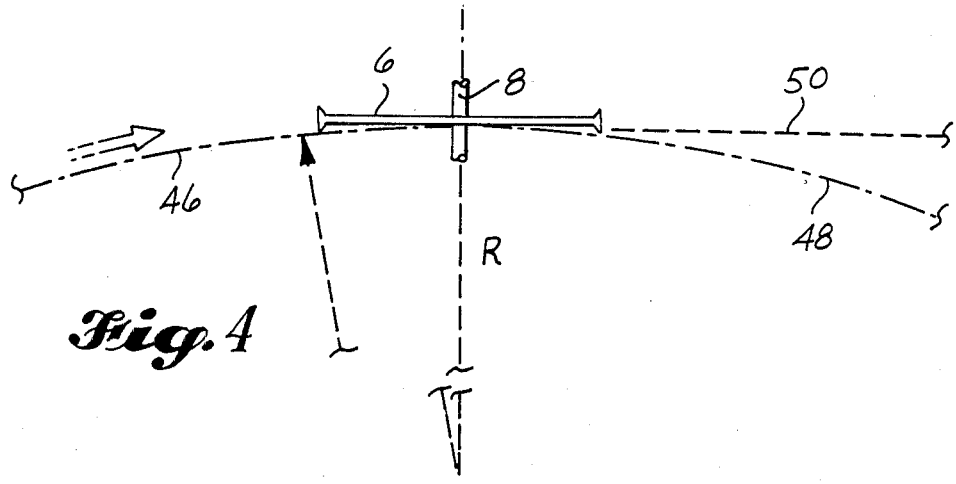
FIG. 4 illustrates the path of a given point on an incoming cant as it approaches the leaves a circular saw during around-the-curve sawing.
Figure 5:
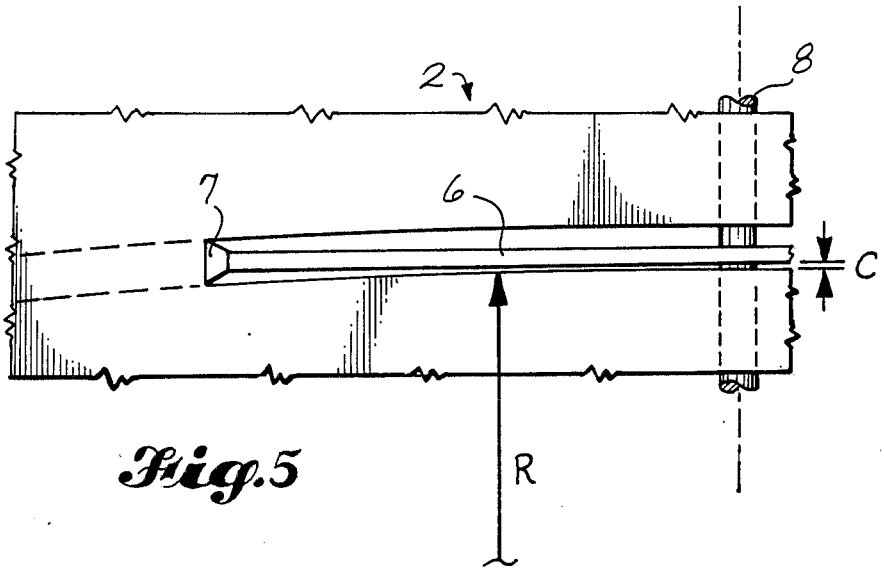
FIGS. 5 and 5A illustrate the relationship of saw side clearance to the present invention.
Figure 5A:
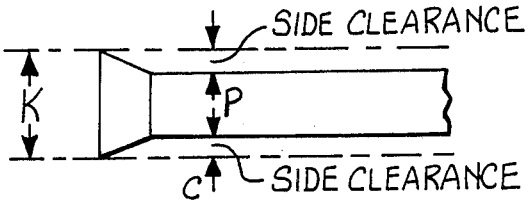

FIGS. 4–5A illustrate one of the limitations which define the minimum radius of curvature of sawing. This minimum radius is in general determined by the available side clearance of the saw. FIG. 4 shows the path of a point on a cant moving into the saw along a circular path 46. Note that this circle is tangent to saw blade 6 at the location of arbor 8. Ideally, one would expect the same point to leave the saw along a similar circular path 48. This is frequently the case when a roll-type conveyor system is used. However, as the lumber leaves the saw, it contains a considerable degree of flexibility not present in the cant entering the saw and it is free to deviate from the "ideal" path 48. In fact, when a slat bed conveyor is used, the exiting lumber will normally assume a nearly straight-line path as shown at 50. As a practical consideration, lumber can be sawn with somewhat more sweep than side clearances would seem to dictate. Some saw plate rubbing does not seem detrimental.

A number of parameters enter into determination of the minimum acceptable radius. These are saw diameter, side clearance between tooth and plate, whether the system is a single or double arbor saw, and cant thickness. A general formula for determining the minimum radius of the fixed curve linebar which will allow normal sawing is as follows for a single arbor gangsaw.

$$\text{Radius} = \frac{4(A + D)(A - B - D) + 4C^2}{8C}$$

where

A is saw diameter,

B is saw extension through the cut,

C is side clearance and

D is cant thickness.

In FIGS. 5 and 5A "K" is used to express saw kerf or maximum width of the tooth, "P" symobolizes saw plate thickness, and "S" is used to express side clearance.

Figure 6:
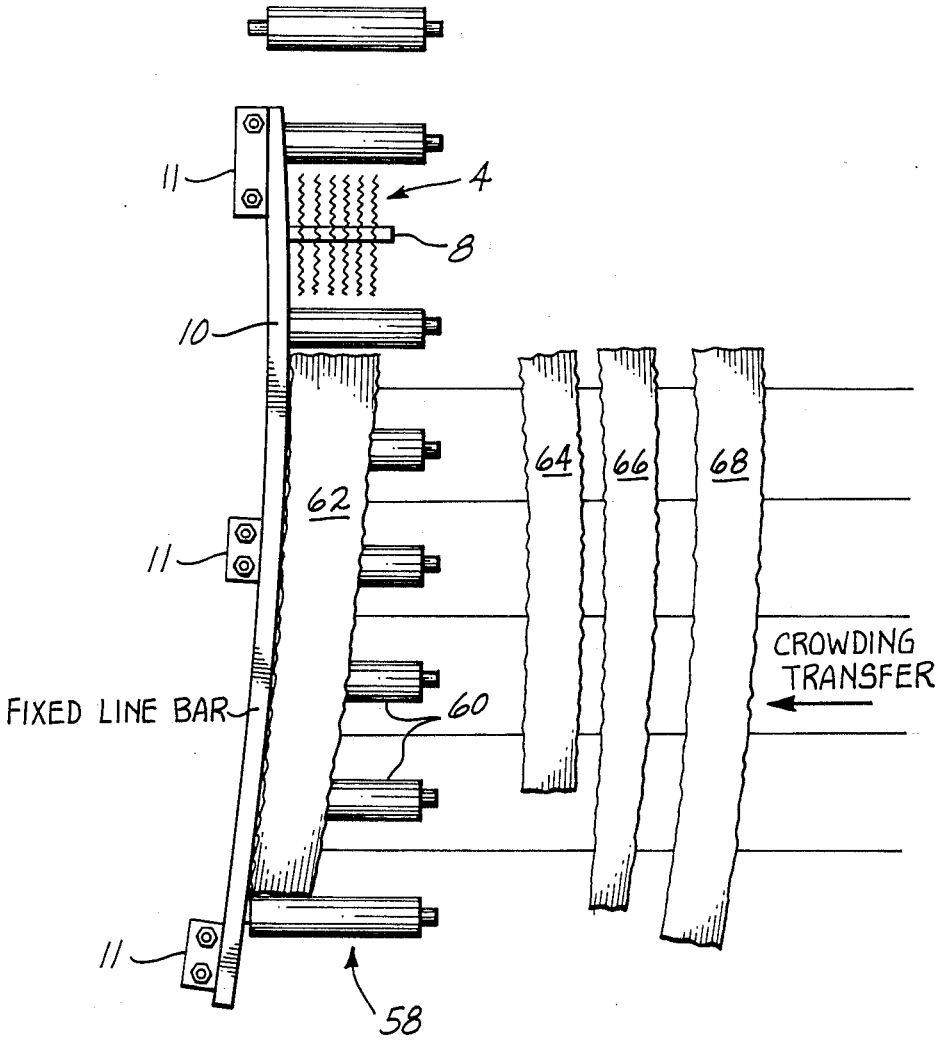
FIG. 6 shows a simple version of the present invention used for feeding cants to a gangsaw.

FIG. 6 illustrates a basic version of the invention. A gangsaw, generally indicated at 52, contains a number of saw blades 4 mounted on an arbor 8. A pair of infeed rolls 54 direct the cant into the saws while outfeed rolls 56 engage the sawn lumber emerging from the saws. Curved linebar 10 is rigidly mounted with reference to the saw by mounts 11. Incoming cants are brought to the saw on a crowding transfer, not numbered, where they can be turned to the proper orientation and fed by the sawyer one at a time onto roll case 58 and against linebar 10. In FIG. 6, cant 62 is shown in position to be sawn while cants 64, 66, and 68 are queued awaiting their turn. The action of rolls 60 tends to force cant 62 against the linebar. In normal operation, no means of inducing side pressure against the cant is necessary.

Figure 7:
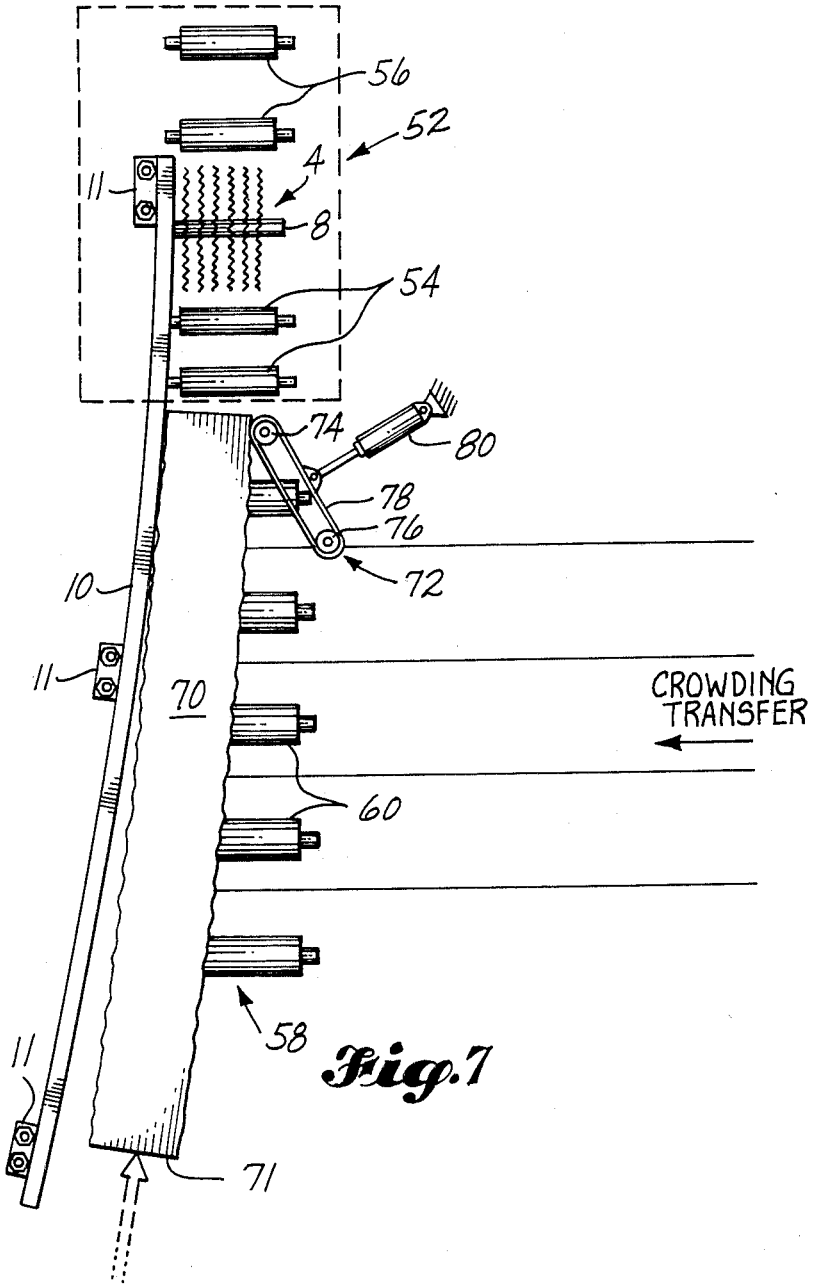
FIG. 7 shows one way in which recovery can be maximized when a straight-sided cant is sawn using the present invention.
Figure 8:
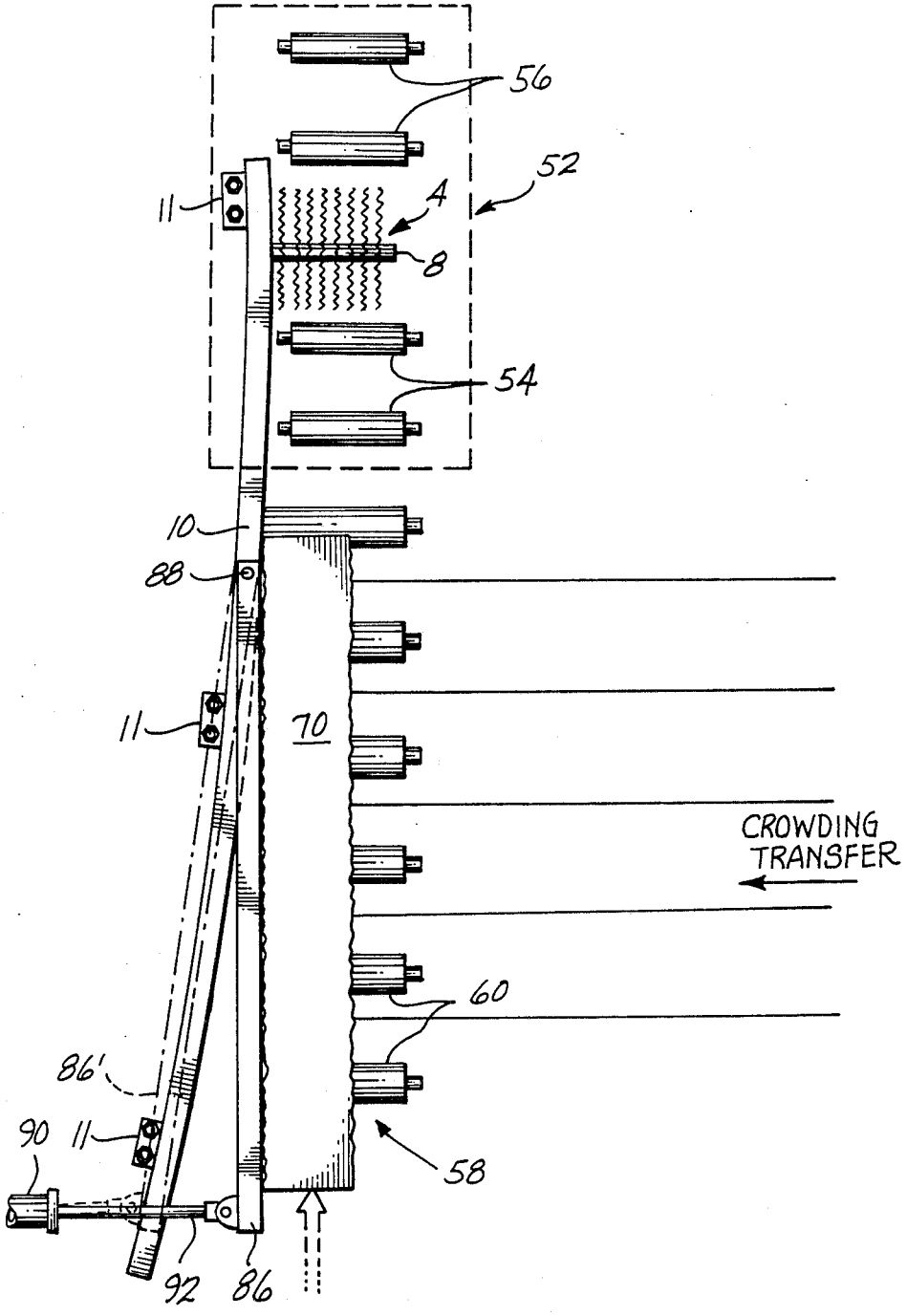
FIG. 8 shows another method by which the invention is adapted for straight-sided cants.

There are times when some side pressure holding the cant against the linebar is advantageous. FIG. 7 is an example of such a situation where a straight cant 70 is in position to be sawn. Even using the curved linebar, the sawyer can orient the cant so that the lead end is tight against the linebar while the lagging end 71 is displaced outwardly somewhat. In this case a side pressure mechanism, generally indicated at 72, is useful for holding the cant against the linebar. As shown in FIG. 7, this side pressure mechanism consists of a pair of pulleys 74, 76 and a belt or chain 78 forced forward against the cant by a hydraulic or pneumatic cylinder 80. One or both of pulleys 74, 76 should be driven so that belt 78 is moving at a speed consistent with the linear speed of roll case 58. This can be done by direct gearing or any other conventional well known means.

Where the cant population contains a fair number of straight-sided pieces, an alternative arrangement shown in FIG. 8 may be employed. Here a straight linebar 86 is pivotally attached at 88 to curved linebar 11. Alternatively, this may be attached to a fixed frame member. Pivot point 88 should be as close to the saws as is reasonably possible. Straight linebar 86 is moved into and out of position by a hydraulic or pneumatic cylinder 90 acting through piston 92. When in the position shown in FIG. 8, the straight linebar assumes priority so that a straightsided cant 70 is fed to the saws in approximately a straight line fashion. When a sweepy cant is to be sawn, linebar 86 is withdrawn to its retracted position 86' by cylinder 90. When in this position, it is out of contact with an incoming cant and curved linebar 10 assumes priority for directing the cant into the saw.

Figure 9:
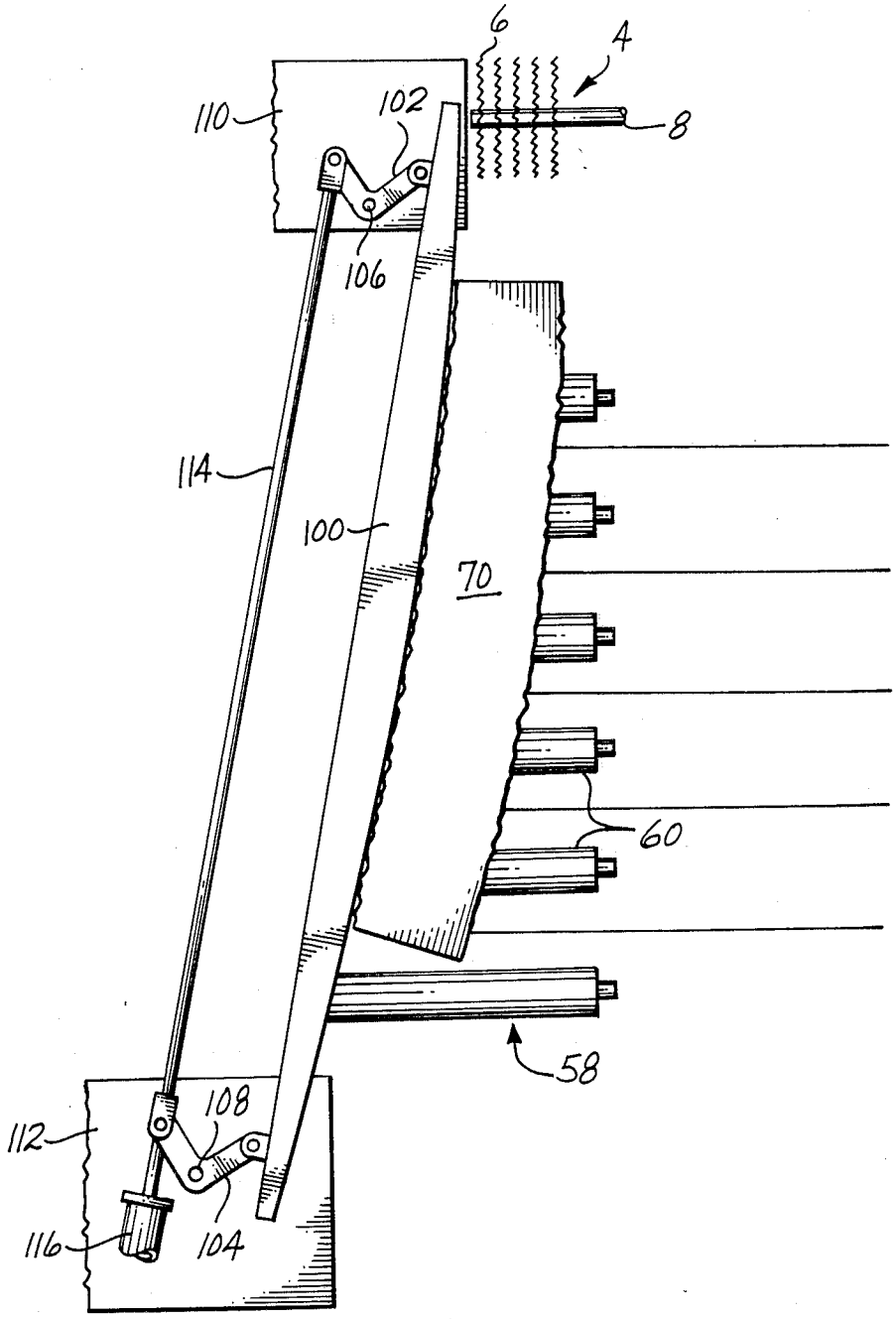
FIG. 9 is a top plan view of one mechanism useful for adjusting offset between the linebar and the zero saw.

It is usually desirable for the sawyer to be able to control offset; i.e., the distance between the linebar and the zero saw at the tangent point. A simple arrangement that permits this is shown in FIG. 9. Here the fixed curve linebar 100 is pivotally mounted to one end of bell cranks 102, 104. These, in turn, are pivotally mounted at 106, 108 to fixed supports or frame members 110, 112. A control rode 114 is attached to the the ends of bell cranks 102, 104. This is positioned by a hydraulic or pneumatic cylinder 116. Other mechanical or fluid means can be readily devised for translating the linebar toward or away from the saws.

Having thus described the best mode of the invention known to the present inventors, it will become readily apparent to those skilled in the art that many variations would be possible without departing from the spirit of the invention. It is the intention of the inventors that the invention should be limited only as defined by the following claims.

We claim:

1. An assembly for guiding a cant or log into a saw which comprises:

at least one saw; and an elongated curved linebar means associated with the saw and positioned so that one end is adjacent to the saw, said linebar means having a curvature that approximates an arc of a circle having a radius falling between about 30 m and 150 m, said linebar means being positioned relative to the saw so that a tangent to the end of the linebar means adjacent to the center portion of the saw is essentially parallel to the plane of the saw in the locale of cutting, whereby the linebar means approximates the average curvature of cants or logs being fed to the saw and the cants or logs can be guided into the saw along a path approximating their radius of curvature.

2. The assembly of claim 1 which further includes a gangsaw containing a plurality of side-by-side saws.

3. The assembly of claim 2 in which the gangsaw is a double arbor type using circular saws.

4. The assembly of claim 2 in which the gangsaw is a single arbor type using circular saws.

5. The assembly of claim 1 in which the saw is a bandsaw.

6. The assembly of claim 1 further in combination with side pressure means to maintain the cant or log in contact with the linebar means in the vicinity of the saws.

7. The assembly of claim 1 further in combination with a straight linebar means, one end of the straight linebar means being pivotally mounted adjacent the saws, and control means to swing the straight linebar means into and out of a priority assuming contacting position with the cant or log so that the cant or log may be directed into the saws along a straight line path.

8. The assembly of claim 7 in which the straight linebar means is pivotally attached to the curved linebar means.

9. The assembly of claim 1 in which the radius of the curved linebar means falls between about 40 m and 115 m.

* * * * *